US005259493A

United States Patent [19]

Johnson

[11] Patent Number: 5,259,493

[45] Date of Patent: Nov. 9, 1993

[54] ROLLER HANDRAIL ENTRY GUARD ASSEMBLY

[75] Inventor: Gerald E. Johnson, Farmington, Conn.

[73] Assignee: Otis Elevator Company, Farmington, Conn.

[21] Appl. No.: 998,482

[22] Filed: Dec. 30, 1992

[51] Int. Cl.[5] ..... B66B 29/04

[52] U.S. Cl. ..... 198/338

[58] Field of Search ..... 198/323, 335, 338

[56] References Cited

U.S. PATENT DOCUMENTS 3,414,109 12/1968 Clark ..... 198/335
3,670,862 6/1972 Kito ..... 198/338
3,809,206 5/1974 Bredehorn ..... 198/338
4,924,995 5/1990 Adrian et al. ..... 198/338

*Primary Examiner*—Joseph E. Valenza
*Attorney, Agent, or Firm*—William W. Jones; Richard D. Getz

[57] ABSTRACT

The handrail reentry housing on an escalator or moving walkway is provided with a set of journaled rollers which are disposed adjacent to each of the exposed surfaces of the handrail. The rollers are spaced apart slightly from the handrail, and are formed from a low coefficient of friction material such as ultra high molecular weight polyethylene. The rollers are freely rotatable and do not contact the moving handrail, therefore objects that may enter the space between the handrail and the reentry housing can be quickly and easily withdrawn without becoming entrapped therein.

4 Claims, 2 Drawing Sheets

ROLLER HANDRAIL ENTRY GUARD ASSEMBLY

DESCRIPTION

1. Technical Field

This invention relates to a safety assembly for use in conjunction with the moving handrail of an escalator or moving walkway, and more particularly, to an assembly which facilitates quick withdrawal of objects which may enter the space between the moving handrail and its reentry housing.

2. Background Art

The possibility of entrapment of objects between the moving handrail of an escalator or moving walkway and its reentry housing has been long recognized in the industry, and numerous solutions have been offered to deal with this problem. Examples of such prior art solutions include: the positioning of brush bristles around the handrail at the reentry; the provision of yielding cushions around the handrail reentry; extended reentry cowls which surround the handrail; object sensors; contact switches which interrupt power to the escalator or walkway, or sound an alarm when touched by foreign objects, to name a few.

Many of these solutions involve complex sensor assemblies; delicate components which may suffer from the unclean environment that they occupy; and most of them are concerned only with detecting an object between the handrail and reentry, and do not facilitate the removal of such objects from the handrail reentry area without shutting down the escalator.

DISCLOSURE OF THE INVENTION

This invention relates to an escalator or moving walkway handrail reentry assembly which facilitates quick and easy removal of foreign objects that enter the space between the moving handrail and the reentry housing.

The handrail passes around the exit newel portion of the escalator or walkway balustrade and into a reentry housing which is disposed at the bottom of the exit newel. A freely rotatable roller set is disposed at the mouth area of the reentry housing, which roller set will be contacted by any foreign object on the handrail that moves into the reentry housing. The individual rollers in the roller set are contoured so as to surround the exposed surfaces of the handrail, i.e., the top and sides of the handrail. The rollers are spaced apart from these areas of the handrail so as not to create an entrapment potential. When a foreign object enters the gap between the moving handrail and the idle rollers, it will immediately contact the rollers. The object can then be easily withdrawn from the reentry housing by pulling back opposite to the direction of movement of the handrail. The rollers will then rotate in the withdrawal direction to assist the foreign object's removal from the reentry housing.

It is therefore an object of this invention to provide an improved handrail reentry guard assembly for use on an escalator or moving walkway.

It is a further object of this invention to provide a handrail reentry guard assembly of the character described which will assist in the withdrawal from the reentry housing of foreign objects on the handrail.

It is another object of this invention to provide a handrail reentry guard assembly of the character described which includes a plurality of freely rotatable contoured rollers which surround the exposed surfaces on the handrail at the mouth of the reentry housing.

These and other objects and advantages of the invention will become more readily apparent from the following detailed description of a preferred embodiment of the invention when taken in conjunction with the accompanying drawings, in which:

BEST MODE FOR CARRYING OUT THE INVENTION

Figure 1:
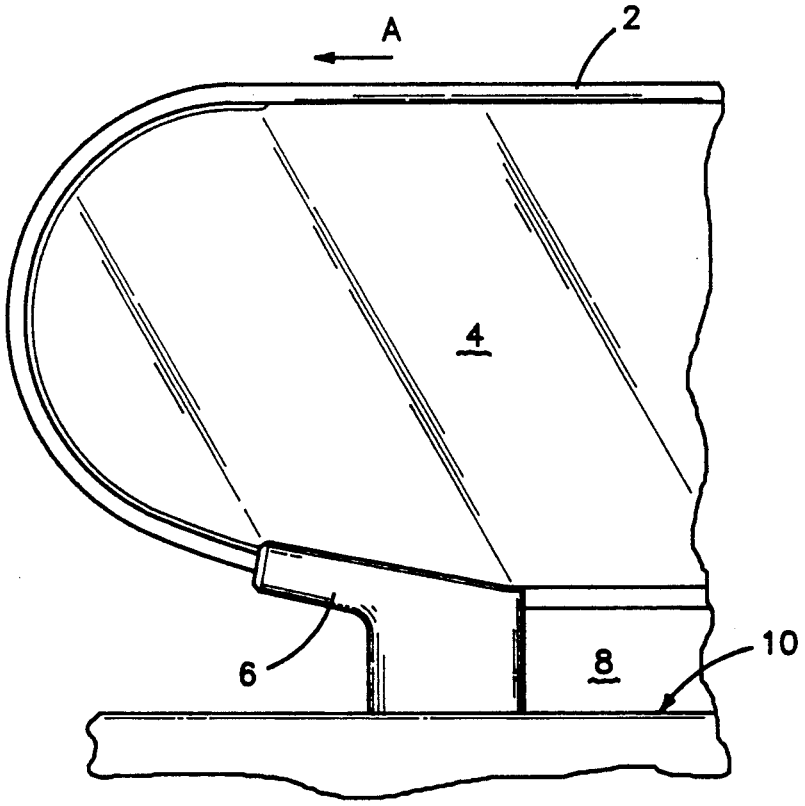
FIG. 1 is a fragmented side elevational view of the exit newel area of an escalator or moving walkway.
Figure 2:
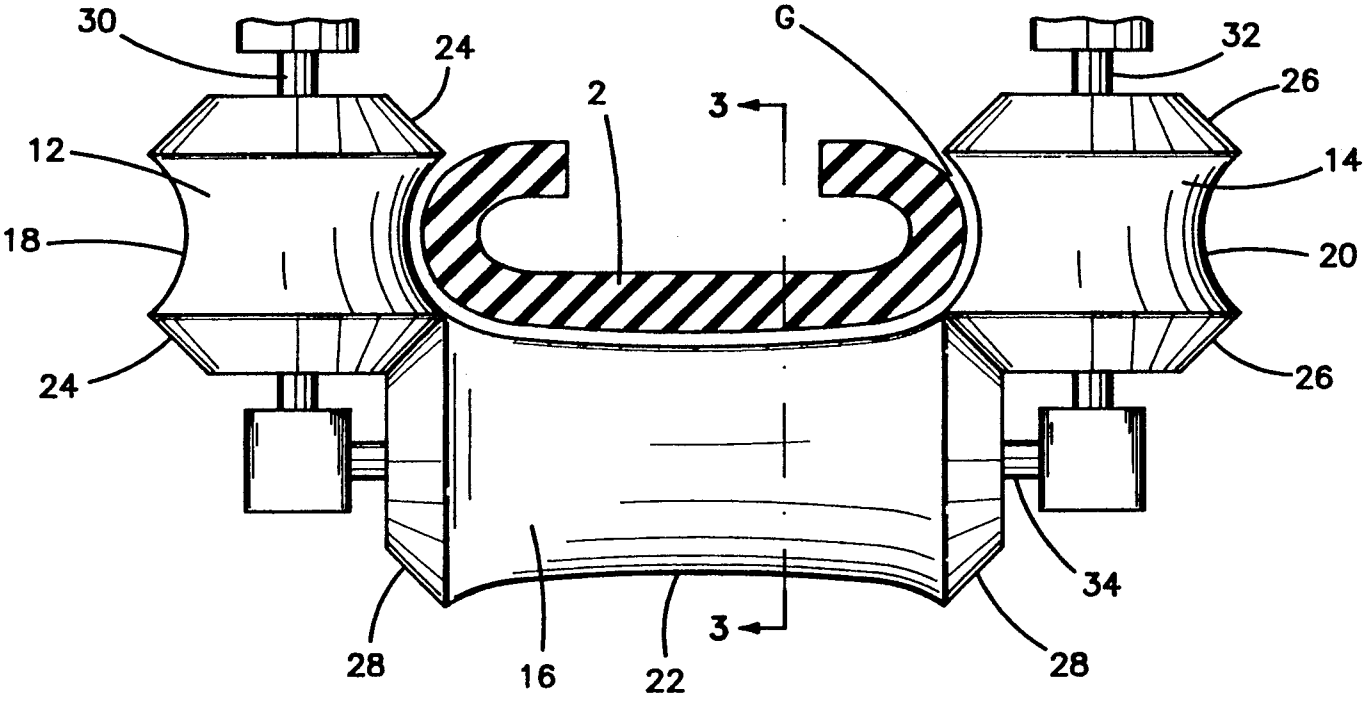
FIG. 2 is an elevational view of the mouth of the handrail reentry housing, with the handrail being shown in section.

Referring now to the drawings, the exit landing area of an escalator or moving walkway is shown in FIG. 1. The handrail is denoted by the numeral 2 and it moves on a guide track (not shown) on top of the balustrade 4 in the direction of the arrow A. The handrail 2 passes around the exit newel and moves into a reentry housing 6, and thence into the deck area 8. The exit landing is denoted generally by the numeral 10.

Just inside of the reentry housing 6 there are disposed three rollers 12, 14 and 16. The rollers 12, 14 and 16 are provided with curved outer surfaces 18, 20 and 22 which are configured to match the shape of the exposed surfaces of the handrail 2. Thus the roller surfaces 18 and 20 match the contour of the outer sides of the handrail 2 and the roller surface 22 matches the contour of the top surface of the handrail 2. The rollers 12, 14, and 16 are also provided with beveled matching contact surfaces 24, 26 and 28. Thus the side rollers 12 and 14 engage the ends of the top roller 16 so as to completely surround the exposed surfaces of the handrail 2. The rollers 12, 14 and 16 are journaled on shafts 30, 32 and 34 so as to be freely rotatable relative to the reentry housing 6 and the handrail 2. A consistent gap G of about 1.5 mm to 2 mm is preferred. The rollers 12, 14 and 16 are preferably formed from a low coefficient of friction material such as ultra high molecular weight polyethylene, or the like, and are provided with a smooth exterior surface. The use of a low coefficient of friction material will reduce the possibility of entrapment of foreign objects between the handrail 2 and the reentry housing 6.

Figure 3:
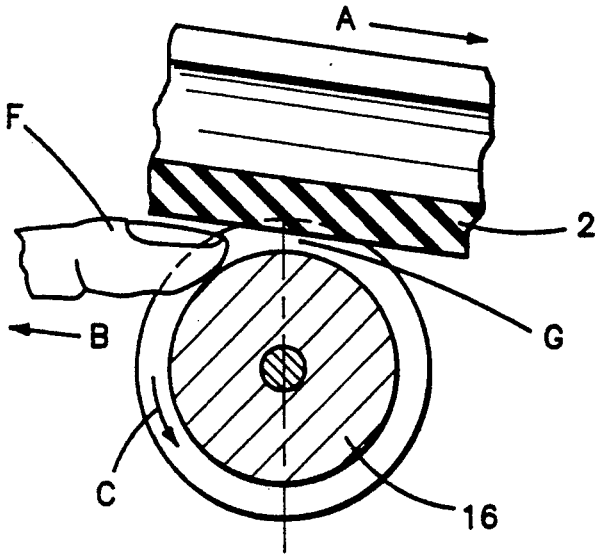
FIG. 3 is a sectional view taken along line 3-3 of FIG. 2.

Referring to FIG. 3, the mode of operation of the entry guard assembly is depicted. The foreign object which enters the reentry housing is a person's finger F. As previously noted, the handrail 2 moves in the direction of the arrow A. If a finger F or some other foreign object follows the handrail 2 into the reentry housing 6, it will contact the roller 16 (or one of the rollers 12 or 14). When the finger F is pulled back in the direction of the arrow B, the roller 16 will rotate in the direction of the arrow C and will facilitate quick withdrawal of the finger F away from the handrail 2. It is important to note that the finger F contacts the roller 16 before entering the gap G, i.e., the smallest distance between the roller 16 and the handrail 2.

It will be readily appreciated that the reentry guard of this assembly is simple in construction, and it operates in a reliable and consistent manner. The use of the roller set which completely surrounds the exposed surfaces of the handrail ensures that foreign objects entering the reentry housing on the handrail will be easily withdrawn without becoming entrapped between the handrail and the reentry housing.

Since many changes and variations of the disclosed embodiment of this invention may be made without departing from the inventive concept, it is not intended to limit this invention, otherwise than as required by the appended claims.

What is claimed is:

1. An escalator or moving walkway handrail reentry assembly through which the handrail moves from an exposed state at the lower end of an exit balustrade to a concealed state beneath the balustrade, said reentry assembly comprising:

a) a reentry housing disposed at the lower end of the exit balustrade, said housing being operable to receive and cover the handrail, said housing having an open mouth portion through which the handrail moves; and b) a plurality of rollers disposed in said reentry housing mouth closely adjacent to, but spaced apart from, passenger-contacting surfaces of the handrail, said rollers being free of contact with said handrail and forming a narrow, restricted opening about said handrail, said rollers being freely rotatable relative to said handrail whereby objects entering said reentry housing mouth on or adjacent to said handrail will contact at least one of said rollers, and can be readily withdrawn from said housing mouth by reason of rotation of said rollers counter to the direction of movement of said handrail.

2. The reentry assembly of claim 1 wherein there are three rollers, one facing each side surface of said handrail, and one facing the top surface of said handrail.

3. The reentry assembly of claim 2 wherein each of said rollers has an outer concave surface which conforms in shape to the faced portion of said handrail opposite said concave surface.

4. The reentry assembly of claim 3 wherein each of said rollers includes beveled matching contact surfaces wherein the contact surfaces on each roller engage contact surfaces on adjacent surfaces to eliminate gaps between adjacent rollers.

* * * * *